US007908754B2

(12) United States Patent
Fritsch

(10) Patent No.: US 7,908,754 B2
(45) Date of Patent: Mar. 22, 2011

(54) LINEAR MARKING APPARATUS

(76) Inventor: Keith Fritsch, Kaukauna, WI (US)

( * ) Notice: Subject to any disclaimer, the term of this patent is extended or adjusted under 35 U.S.C. 154(b) by 95 days.

(21) Appl. No.: 12/430,808

(22) Filed: Apr. 27, 2009

(65) Prior Publication Data

US 2010/0269360 A1 Oct. 28, 2010

(51) Int. Cl.
*B44D 3/38* (2006.01)

(52) U.S. Cl. ..... 33/414; 33/451

(58) Field of Classification Search ..... 33/414, 33/413, 451, 333, 334
See application file for complete search history.

(56) References Cited

U.S. PATENT DOCUMENTS

| | | | | | |
|---|---|---|---|---|---|
| 577,708 | A * | 2/1897 | Barrie | 33/342 |
| 1,891,786 | A * | 12/1932 | Smith | 33/413 |
| 2,964,245 | A * | 12/1960 | Anderson et al. | 239/150 |
| 3,099,091 | A * | 7/1963 | Hindall | 33/414 |
| 3,153,285 | A * | 10/1964 | Senko | 33/410 |
| 4,189,844 | A | 2/1980 | Riggins, Sr. | |
| 4,551,922 | A * | 11/1985 | Someya | 33/414 |
| 5,119,565 | A * | 6/1992 | Horvath et al. | 33/405 |
| 5,699,622 | A | 12/1997 | Umbro | |
| 6,138,370 | A | 10/2000 | Rolfe | |
| 6,487,783 | B1 | 12/2002 | Thomas, Jr. | |
| 6,678,961 | B1 * | 1/2004 | Panahi | 33/414 |
| D488,729 | S | 4/2004 | Golaszewski et al. | |
| 7,028,411 | B1 * | 4/2006 | Kasche | 33/451 |
| 7,086,174 | B2 * | 8/2006 | Scarborough | 33/761 |
| 7,707,734 | B2 * | 5/2010 | Alexander | 33/414 |
| 2006/0000099 | A1 | 1/2006 | Tessel | |
| 2009/0025237 | A1 * | 1/2009 | Alexander | 33/414 |

* cited by examiner

*Primary Examiner* — Yaritza Guadalupe-McCall
(74) *Attorney, Agent, or Firm* — Absolute Technology Law Group, LLC

(57) ABSTRACT

The Linear Marking Apparatus that which includes an embedded marking substance (chalk) reel during use, allowing a single worker to effectively snap a marking line over the work surface. In various embodiments, the Linear Marking Apparatus the tool can also be utilized as a measuring device, a straight edge, or a level. Potential uses of the Linear Marking Apparatus include marking lines on walls, ground, vehicles, concrete, roofing, floors, window, boats, furnishings, ceilings.

12 Claims, 5 Drawing Sheets

LINEAR MARKING APPARATUS

FIELD OF THE INVENTION

The present invention relates to the field of tools, and more specifically to a multifunctional tool which allows a single worker to snap a single marking line over the work surface.

GLOSSARY

Figure 1A:
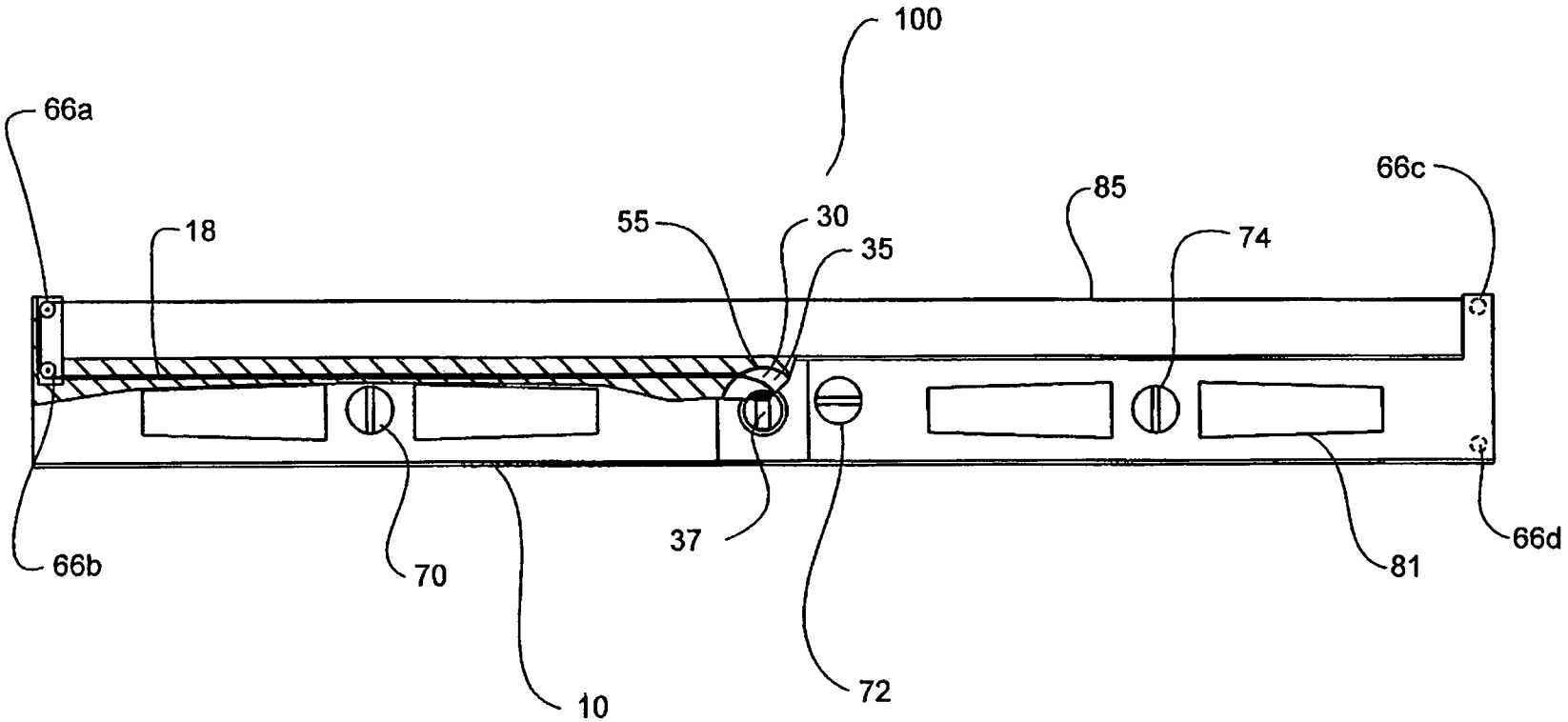
FIG. 1*a* illustrates an exemplary embodiment of a Linear Marking Apparatus.

As used herein, the term "linear marking apparatus" means an apparatus which functions as a chalk line and may also function as a measuring device, a straight edge, and a level.

As used herein, the term "marking tool" means a tool which has the functionality to allow a user to mark straight line using chalk, dye, ink or any other marking substance known in the art.

As used herein, the term "internally mounted component" means within a housing.

As used herein, the term "externally mounted component" means not within a housing.

As used herein, the term "pulley component" means any structural component which guides and/or supports a line. A pulley component may be threaded, contoured, contain grooves and/or apertures, or may integrally constructed with a housing such that a housing operates as a pulley component.

As used herein, the term "spool component" means any rotational or pivotal component around which a line is wound. A spool component may be threaded, contoured, contain grooves and/or apertures.

A "tension adjustment control" is any component which increases or decreases the tension of a line by manipulating a pulley component. A tension adjustment control may include but is not limited to a taut gear component, a pivotal lever mounted between two pulleys, a set screw, a rotational component, a spool, another pivotal component, rotational component, a lever, a bolt, spring component or assembly and/or other securing component for a line or any other component known in the art which may be adapted to adjust the tension of line.

As used herein, a "line" is any string, string-like, wire or strand type structure.

BACKGROUND

A chalk line is a marking tool for marking long, straight lines on relatively flat surfaces, much farther than is practical by hand or with a straightedge. It is an important tool in carpentry, painting, construction, surveying trades and in other mechanical arts which require a straight line as a reference point.

A chalk line draws straight lines by the action of a taut string. Specifically, the string (previously impregnated or coated with a loose dye such as chalk) is laid across the surface to be marked and pulled tight. The string is then manually pulled or "snapped" to cause the string to strike the surface, leaving a straight line.

A level-tool is another tool known in the art and often used by artisans and trades people (sometimes in conjunction with chalk lines) to determine whether a surface is flat or level before a line is snapped on the surface. A level includes tubular receptacles positioned within a frame and partially filled with fluid so that movement of an air space within the tubes which signals whether a surface is level. A level tool may have two or more tubular receptacles placed in different positions so that the air space within the tubes determines whether with vertical, horizontal and angular surfaces are level.

Extendable tools are also known in the art. For example, U.S. Pat. No. 4,435,908 issued to Semler, discloses a typical level device. Semier '908 teaches a leveling apparatus that is stored in compact form and can be extended up to three times its length.

A limitation known in the art with traditional chalk lines is the need for two people to carry out the task of snapping a line. Often two workers are not available or on site to operate a device used for snapping a line.

It is an objective of the invention to obviate the need for two persons to operate a chalk line and provide a practical solution for situations where only one user is present to carry out the task of creating a line marking (e.g., chalk line).

It is a further objective of the present invention to create multi-functional marking tool which affords the functionality of numerous marking devices and levels.

It is also an objective of the present invention to create a device which allows users to more easily mark vertical lines (e.g. without having one person secure a line from a ladder or platform.)

SUMMARY OF THE INVENTION

The present invention is a specially designed, Linear Marking Apparatus that which includes an embedded marking substance (chalk) reel during use, allowing one worker to effectively use this marking tool and snap a marking line over the work surface. In various embodiments, the Linear Marking Apparatus can be utilized as a measuring device, a straight edge, or a level. Potential uses of the Linear Marking Apparatus include marking lines on walls, ground, vehicles, concrete, roofing, floors, window, boats, furnishings and ceilings.

The Linear Marking Apparatus disclosed herein which includes a reservoir containing a marking material and the reservoir is secured to at least one surface of a housing. The Linear Marking Apparatus further includes at least two pulley components positioned at opposite ends of the housing and a line adapted to receive marking material (e.g. chalk). The line is secured at opposite ends to pulley components. Further embodiments may include a spool component, a battery operated spool component, a tension control component, a gripping component, one or more level bubbles, and/or a straight edge.

Other embodiments may be extendable. For example, housing components may move slidably within each other, or over a track component. The apparatus may be extended to a length of two to twenty feet (for example a length of eight to ten feet).

DETAILED DESCRIPTION OF INVENTION

For the purpose of promoting an understanding of the present invention, references are made in the text to exemplary embodiments of a Linear Marking Apparatus, only some of which are described herein. It should be understood that no limitations on the scope of the invention are intended by describing these exemplary embodiments. One of ordinary skill in the art will readily appreciate that alternate but functionally equivalent Linear Marking Apparatus may be used. The inclusion of additional elements may be deemed readily apparent and obvious to one of ordinary skill in the art. Specific elements disclosed herein are not to be interpreted as limiting, but rather as a basis for the claims and as a representative basis for teaching one of ordinary skill in the art to employ the present invention.

It should be understood that the drawings are not necessarily to scale, instead emphasis has been placed upon illustrating the principles of the invention. In addition, in the embodiments depicted herein, like reference numerals in the various drawings refer to identical or near identical structural elements.

Moreover, the-terms "substantially or approximately" as used herein may be applied to modify any quantitative representation that could permissibly vary without resulting in a change in the basic function to which it is related. For example, a Linear Marking Apparatus may include more or fewer functional elements, may include more or fewer level components or spools or may include components which are placed in locations on a Linear Marking Apparatus which are different than the exemplary embodiments shown.

FIG. 1*a* illustrates a sectional view of an exemplary, non-extendable embodiment of Linear Marking Apparatus 100, which includes a housing 10, which in the embodiment shown is comprised of a square tubular body 10. In the embodiment shown housing 10 is aluminum, but in other embodiments housing 10 may be made of wood, plastic, or other metals, and may be machined, molded, stamped or extruded. In the embodiment shown is a singularly constructed component, but in other embodiments housing 10 may be constructed from multiple components.

In the embodiment shown, housing 10 includes at least one internal channel 18 which may be hollow or partially hollow or contain apertures or recesses for depositing one or more marking material reservoir 30. In the embodiment shown marking material reservoir 30 includes powdered chalk by may contain any other marking substance known in the art.

In other embodiments housing 10 may be a solid or flat mounting component to which all other components are externally mounted, and may omit channel 18.

Also shown in FIG. 1*a* is spool component 35. In various embodiments, more of fewer spool components may be utilized, and spool components may be of different shapes and configurations, or internally or externally mounted. In the embodiment shown, spool component 35 further includes pivotal handle 37 which allows the user to rotate spool component 35 (but in other embodiments may include functional equivalents such as a knob, lever, protuberance or other structures.)

The exemplary embodiment shown in FIG. 1*a* further includes at two internally mounted pulley components 66*a*, 66*b*, and two externally mounted pulley components 66*a* and 66*b*. Other embodiments may include more or fewer or differently proportioned or configured pulley components. Additionally, pulley on a Linear Marking Apparatus 100 may be of varying sizes and shapes, and may be asymmetrically or symmetrically mounted.

FIG. 1*a* further illustrates line 85, which is a string or string-like component made of any material adapted to hold chalk or marking material, and which can be made taut and/or rigid to create an accurate line.

The embodiment shown in FIG. 1*a* also includes reservoir 56 to add chalk. Reservoir 55 to store marking material (e.g., chalk powder) may be an aperture or receptacle internally or externally mounted. Reservoir 55 may be refillable or disposable. In the embodiment shown, reservoir 55 surrounds spool 35 so that line 85 travels through reservoir 55 and is coated with a marking material.

Figure 2:
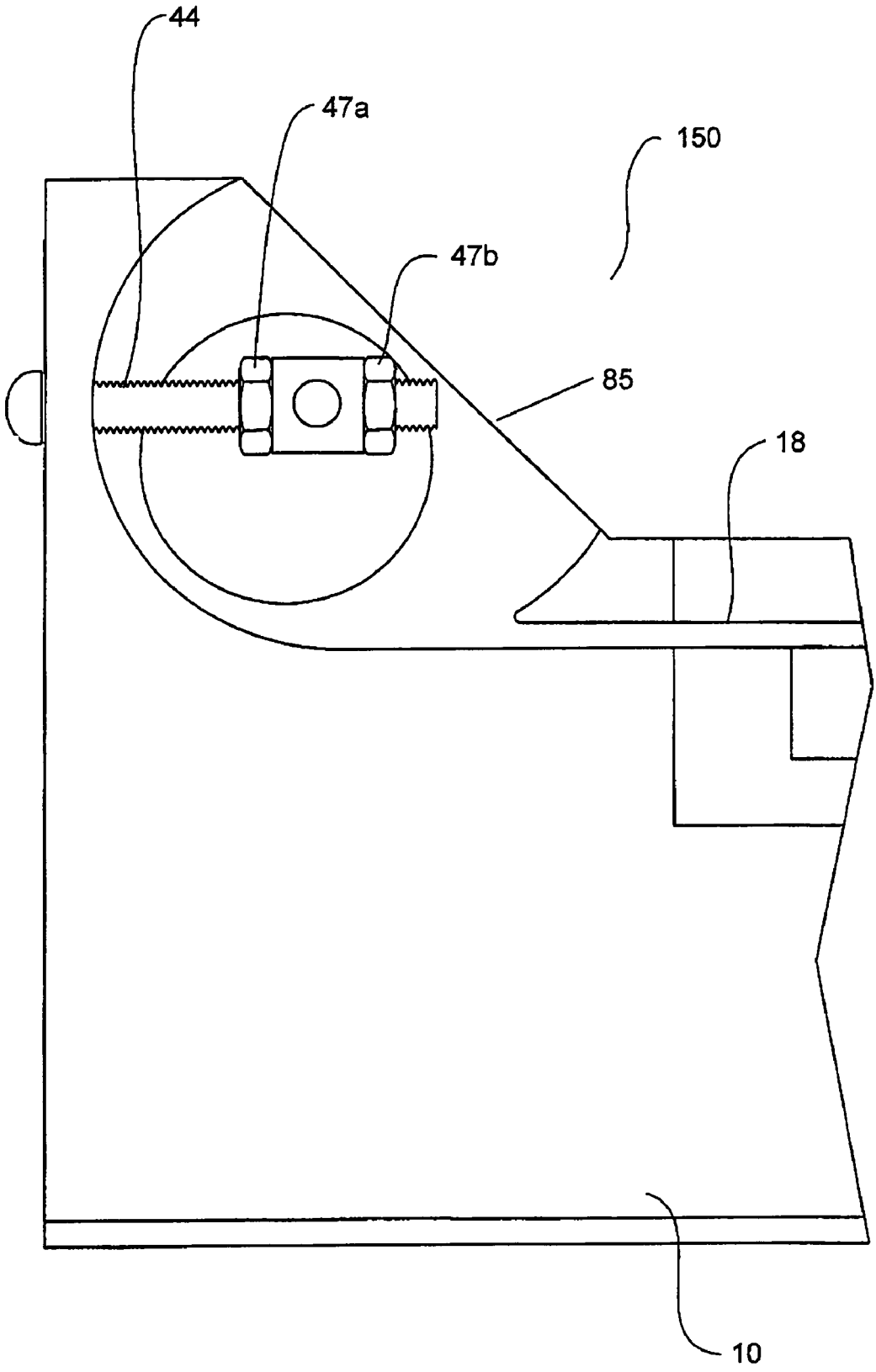
FIG. 2 illustrates an exemplary embodiment of a tension adjustment control for a Linear Marking Apparatus.

In various embodiments, Linear Marking Apparatus 100 may include a tension adjustment control to pull line 85 taut (see FIG. 2). In various embodiments, a tension adjustment control may include but is not limited to a taut gear component, a pivotal lever mounted between two pulleys, a set screw, a rotational component, a spool, another pivotal component, rotational component, a lever, a bolt, spring component or assembly, and or securing component for a line or any other component known in the art which may be adapted to adjust the tension of line 85.

Various embodiments of Linear Marking Apparatus 100 may include variations of pulley components 66*a*, 66*b*, 66*c*, 66*d* and spool component 35 may be constructed from plastic, metal, wood, rubber or metal. In various embodiments, pulley components 66*a*, 66*b*, 66*c*, and 66*d* may include grooves or apertures, line track guides or contours.

In the embodiment shown in FIG. 1*a*, housing 10 includes two level bubbles 70, 72, and 74, but other embodiments may include a single level bubble or three or more level bubbles.

Embodiments of Linear Marking Apparatus 100 may vary in size and dimension. For example, housing 10 may vary in thickness or may be flat as necessary to accommodate insertion or mounting of internal and/or external components as described herein.

Housing 10 may include markings to allow a user to measure distance or dimensions.

In still other embodiments, housing 10 may include optional features such as a gripping aperture 81 or a handle or strap which facilitates grasping.

Further embodiments of Linear Marking Apparatus 100 may include lighting, internal guides or specially constructed casings or flaps to protect a chalk line (e.g. from rain, moisture, dust and debris).

Figure 1B:
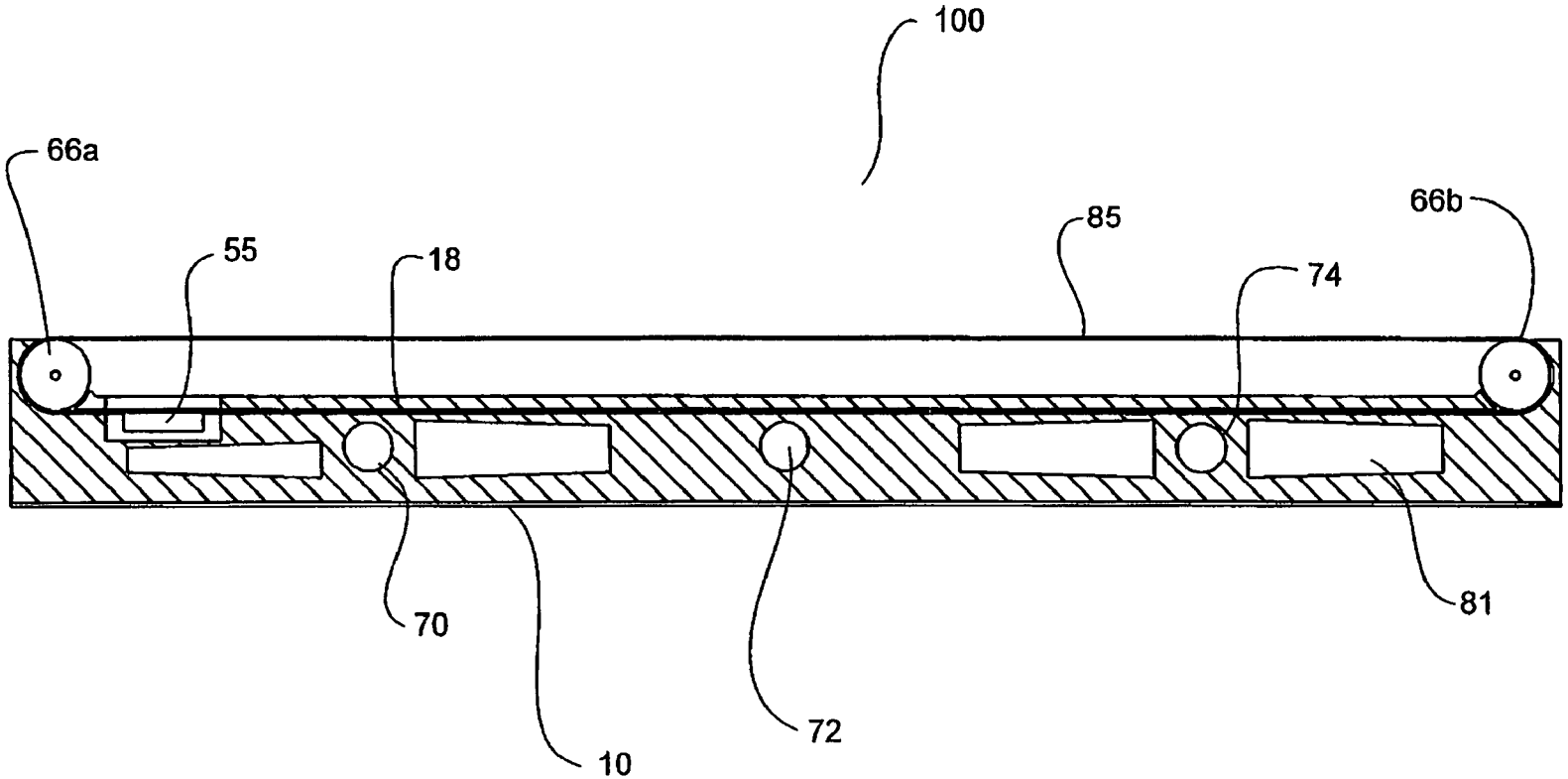
FIG. 1*b* illustrates an alternate embodiment of a Linear Marking Apparatus.

FIG. 1*b* illustrates an exemplary embodiment of Linear Marking Apparatus 100 utilizes two pulley components 66*a* and 66*b* which are larger than those shown in FIG. 1*a*. The embodiment shown in FIG. 1*b* does not include a spool because line 85 forms a continuous loop which travels through marking material reservoir 55 when line 85 is mechanically or manually rotated.

FIG. 2 illustrates an exemplary embodiment of tension adjustment control 150. In the embodiment shown, tension adjustment control 150 includes bolt 44, to which pulley is 68 (not shown) is mounted. When bolt 44 is rotated or pivoted, more or less tension is applied to line 85. In the embodiment shown, bolt 44 is secured by nuts 47*a* and 47*b*. In other embodiments, tension adjustment control 150, may be any component which increases or decreases the tension of line 85 by manipulating a pulley component. A tension adjustment control may include but is not limited to a taut gear component, a pivotal lever mounted between two pulleys, a set screw, a rotational component, a spool, another pivotal component, rotational component, a lever, a bolt, spring component or assembly and/or other securing component for a line or any other component known in the art which may be adapted to adjust the tension of line.

Figure 3A:
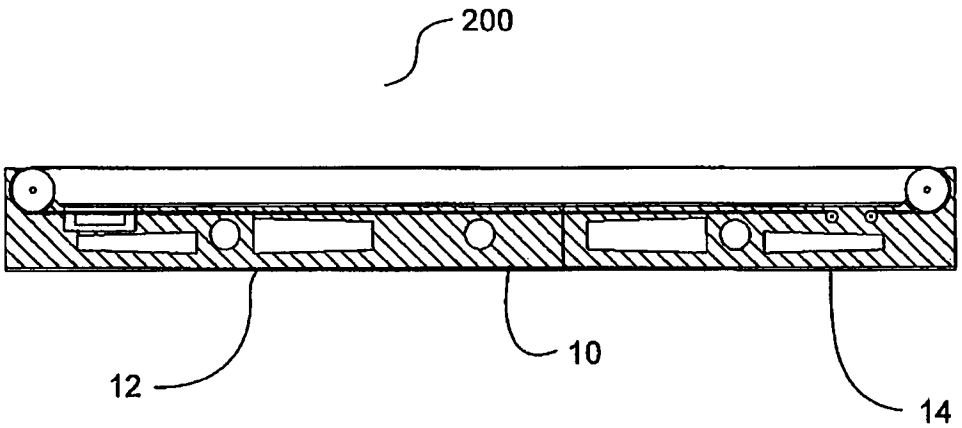
FIG. 3*a* illustrates an extendable embodiment of a Linear Marking Apparatus.

FIG. 3*a* illustrates a sectional view of an extendable embodiment of Linear Marking Apparatus line 200 in the closed position.

In the embodiment shown in FIG. 3*a* Linear Marking Apparatus line 200 which is extendable from a range of two (2) to twenty (20) feet. In the embodiment shown in FIG. 2, Linear Marking Apparatus 200 extends approximately six (6) feet in the closed position to approximately ten (10) feet when in the fully extended position.

Figure 3B:
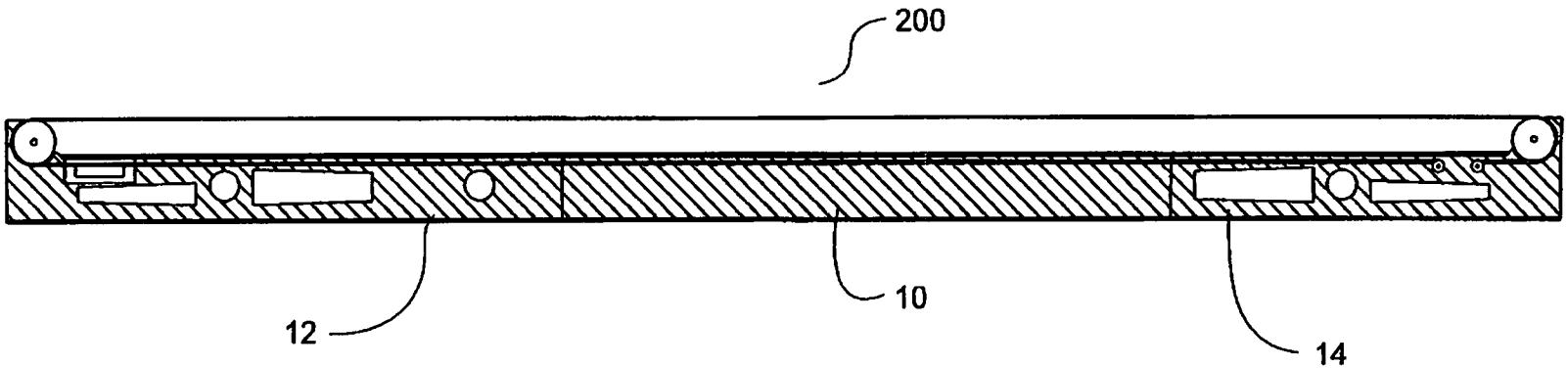
FIG. 3*b* illustrates an exemplary extendable embodiment of a Linear Marking Apparatus.

FIG. 3*b* illustrates sectional view of an exemplary extendable embodiment of Linear Marking Apparatus line 200.

In the embodiment shown in FIGS. 3*a* and 3*b* housing 10 is constructed in two housing parts 12, 14 which are telescoping. In the embodiment shown, inner housing part 12 moves slidably within outer housing part 14. Inner housing part 12 in contoured slidably within outer housing part 14. In various embodiments, housing 10. May be constructed of more or fewer components and of any dimension which may functionally operate as a housing for a Linear Marking Apparatus.

Figure 3C:
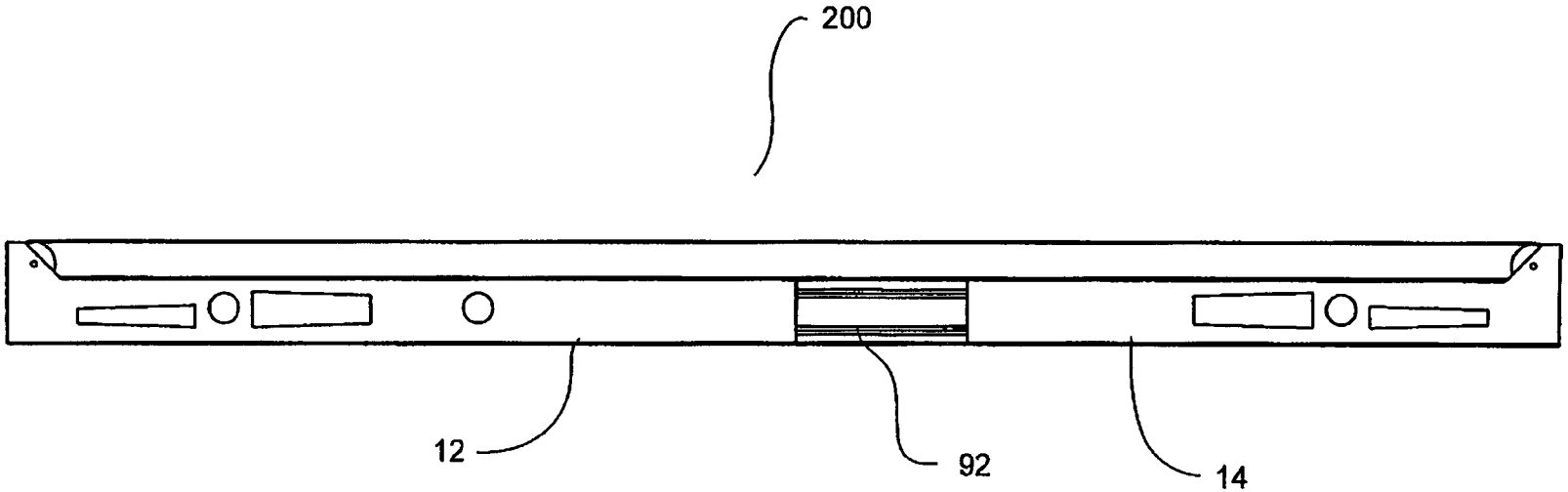
FIG. 3*c* illustrates an alternate embodiment of an extendable Linear Marking Apparatus.

FIG. 3*c* illustrates an extendable embodiment of Linear Marking Apparatus 200 which includes an internal track component 92, and which allows housing parts 12 and 14 to slide over the track.

What is claimed:

1. A dual-level linear marking apparatus that enables a single worker to snap a marking line comprised of:

a substantially linear housing forming at least one substantially planar surface comprised of a square tubular body, and at least one internal channel parallelly positioned to said substantially linear housing;

a reservoir containing a marking material, said reservoir secured to at least one surface of said housing;

at least two pulley components parallelly positioned at opposite ends of said housing;

at least one tension control component having at least one tension adjustment control adapted to manipulate at least one of said at least two pulley components, at least one horizontal level bubble parallelly positioned within said substantially linear housing;

at least one vertical level bubble perpendicularly positioned within said substantially linear housing;

a line with no loose ends adapted to receive said marking material, said line secured to each of said at least two pulley components as a continuous loop and mounted to move slidably through said reservoir parallel with said housing.

2. The apparatus of claim 1 wherein said apparatus further includes at least one spool component.

3. The apparatus of claim 2 wherein said at least one spool component is battery operated.

4. The apparatus of claim 2 wherein said at least one spool component further includes a groove.

5. The apparatus of claim 2 wherein each of said at least one spool component includes at least one aperture.

6. The apparatus of claim 1 wherein said housing further includes a groove and operates as a pulley.

7. The apparatus of claim 1 wherein said apparatus further includes at least one gripping component selected from a group consisting of a gripping aperture, a handle, and a strap.

8. The apparatus of claim 1 wherein said tension control component is selected from a group consisting of a taut gear component, a pivotal lever mounted between two pulleys, a set screw, a rotational component, a spool, a pivotal component, rotational component, a lever, a bolt, spring component or assembly, and stationary securing component for a line.

9. The apparatus of claim 1 wherein said housing consists of at least two housing components.

10. The apparatus of claim 9 wherein said at least two housing components are telescoping.

11. The apparatus of claim 9 wherein said at least two housing components are adapted to move slidably over a track component.

12. The apparatus of claim 9 wherein said apparatus is extendable to a length of eight to ten feet.

* * * * *